US008529332B2

(12) United States Patent
Bennett et al.

(10) Patent No.: US 8,529,332 B2
(45) Date of Patent: Sep. 10, 2013

(54) GAMING MACHINE WITH ENHANCED FEATURE INDICATOR

(75) Inventors: Nicholas Luke Bennett, Manly Vale (AU); George Roukis, Miranda (AU)

(73) Assignee: Aristocrat Technologies Australia Pty Ltd (AU)

( * ) Notice: Subject to any disclaimer, the term of this patent is extended or adjusted under 35 U.S.C. 154(b) by 728 days.

(21) Appl. No.: 11/962,484

(22) Filed: Dec. 21, 2007 (Under 37 CFR 1.47)

(65) Prior Publication Data

US 2008/0119282 A1 May 22, 2008

Related U.S. Application Data

(63) Continuation-in-part of application No. 10/752,773, filed on Jan. 6, 2004.

(30) Foreign Application Priority Data

Jan. 14, 2003 (AU) ..... 2003900134

(51) Int. Cl.
*A63F 9/24* (2006.01)

(52) U.S. Cl.
USPC ..... 463/20; 463/16; 463/25

(58) Field of Classification Search
USPC ..... 463/16, 20
See application file for complete search history.

(56) References Cited

U.S. PATENT DOCUMENTS

| | | | | |
|---|---|---|---|---|
| 4,874,173 | A | 10/1989 | Kishishita | |
| 5,102,134 | A * | 4/1992 | Smyth | 463/21 |
| 6,053,813 | A | 4/2000 | Mathis | |
| 6,251,013 | B1 | 6/2001 | Bennett | |
| 6,296,251 | B1 * | 10/2001 | Webb | 273/292 |
| 6,319,124 | B1 * | 11/2001 | Baerlocher et al. | 463/20 |
| 6,439,993 | B1 * | 8/2002 | O'Halloran | 463/16 |
| 6,544,120 | B2 | 4/2003 | Ainsworth | |
| 6,632,140 | B2 * | 10/2003 | Berman et al. | 463/18 |
| 7,121,942 | B2 | 10/2006 | Baerlocher | |
| 2002/0132659 | A1 | 9/2002 | DeMar et al. | |

FOREIGN PATENT DOCUMENTS

| | | |
|---|---|---|
| NZ | 510297 | 8/2002 |
| WO | 0032286 | 6/2000 |
| WO | 0207836 | 1/2002 |

OTHER PUBLICATIONS

Office Action dated Sep. 26, 2012 corresponding to U.S. Appl. No. 13/450,117.

Office Action dated Dec. 7, 2012 corresponding to U.S. Appl. No. 13/450,117.

* cited by examiner

*Primary Examiner* — Omkar Deodhar

(74) *Attorney, Agent, or Firm* — McAndrews, Held & Malloy, Ltd.

(57) ABSTRACT

A gaming machine 10 has a display 14 and a game controller arranged to control images of symbols displayed on the display 14. The game controller is arranged to play a game 16 wherein at least one random event is caused to be displayed on the display and, if a predefined winning event occurs, the machine 10 awards a prize. The gaming machine 10 comprises a bonus feature that is triggered when a trigger condition occurs in a base game and an indicator incorporated in the bonus feature indicates to the player that the chance of winning during the bonus feature is higher than in the base game that triggered the bonus feature. In the bonus feature a special symbol is added to a spinning reel if a specified event occurs in the bonus feature.

13 Claims, 5 Drawing Sheets

GAMING MACHINE WITH ENHANCED FEATURE INDICATOR

RELATED APPLICATIONS

The present application relates to, and claims the benefit of priority as a continuation in part from, U.S. patent application Ser. No. 10/752,773, filed on Jan. 6, 2004, entitled "Gaming Machine with Enhanced Feature Indicator," which claims priority to Australian Patent Application No. 2003900134, filed on Jan. 14, 2003, each of which is herein incorporated by reference in its entirety.

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games and/or game features which are popular with the players as a mechanism for improving sales, retaining customers and attracting new customers.

Still further, these days it is becoming increasingly common to provide bonus features associated with games to enhance player enjoyment and to maintain player interest. These features are becoming increasingly complex to the extent that gaming machines these days often have "Help" screens to explain to players how the features operate and what they entail. A large percentage of players do not have the inclination to read such screens and would rather just play the game. Hence such screens could be a disincentive to a player to play that particular gaming machine. This could have adverse consequences for the revenue of an operator of the venue in which the gaming machine is installed.

SUMMARY OF THE INVENTION

According to a first aspect of the invention there is provided a method of operating a gaming machine having a display and a game controller arranged to control images of symbols displayed on the display, the game controller being arranged to play a spinning reel game wherein at least one random event is caused to be displayed on the display and, if a predefined winning event occurs, the machine awards a prize, the method comprising:

initiating a feature including a series of spinning reel games, each of the spinning reel games having associated reel strips carrying a plurality of symbols, including at least one accumulator symbol;

in response to said at least one accumulator symbol being spun up on a reel strip, adding at least one special symbol to said reel strip to increase the chance of said special symbol being spun up;

spinning said reel strips to provide a visible indication of said increase in the chance of said special symbol being part of a winning event during the spinning reel game; and awarding a prize if said special symbol forms part of a winning event.

The at least one added special symbol may act as an accumulator symbol in a following reel spin, and may have an associated visual attribute. The visual attribute of the special symbol may be a colour distinguishable from colours of other symbols on the spinning reels.

The added special symbols may associated with a scorecard that may provide a higher payout.

The addition of a special symbol to said reel strip may increase a length of the reel strip. Alternatively, the special symbol may replace an existing symbol or may be juxtaposed with an existing symbol on the reel strip.

According to a further aspect of the invention there is provided a method of operating a gaming machine having a display and a game controller arranged to control images of symbols displayed on the display, the game controller being arranged to play a spinning reel game wherein at least one random event is caused to be displayed on the display and, if a predefined winning event occurs, the machine awards a prize, the method comprising:

initiating a feature including a series of spinning reel games, each of the spinning reel games having associated reel strips carrying a plurality of symbols;

in response to the occurrence of a specified outcome on a reel strip, adding at least one special symbol to said reel strip, the addition of the special symbol increasing the probability of a winning event occurring;

spinning said reel strips; and awarding a prize if a winning event occurs.

The specified outcome may be the display of a wild symbol.

According to further aspects, the invention broadly resides in instructions executable by a game controller to implement the methods described in preceding paragraphs and to such instructions when stored in a storage medium readable by the game controller. The instructions may also be conveyed as a data signal.

The gaming machine described herein has a display and a game controller arranged to control images of symbols displayed on the display, the game controller being arranged to play a game wherein at least one random event is caused to be displayed on the display and, if a predefined winning event occurs, the machine awards a prize, the gaming machine comprising a bonus feature that is triggered when a trigger condition occurs in a base game and an indicator incorporated in the bonus feature that indicates to the player that the chance of winning during the bonus feature is higher than in the base game that triggered the bonus feature.

The format of the bonus feature may be the same as that of the base game apart from the indicator incorporated in the bonus feature. Thus, the base game may be a spinning reel game with the bonus feature being a series of spinning reel games.

The indicator may be a variable device that indicates to the player that, as the bonus feature, i.e. the series of spinning reel games, progresses, the potential return to player percentage increases. The indicator may be related to the occurrence of a special symbol on the display of the gaming machine during play of the bonus feature. More particularly, the indicator may be the quantity of a special symbol that occurs during the bonus feature, i.e. on at least one of the reels of the games of the series of free games. The occurrence of the special symbol may increase on the at least one reel as the bonus feature, being the series of spinning reel games, progresses.

The controller may provide the variability of the indicator by causing a special symbol to be added in respect of the bonus feature. The special symbol may be added upon the occurrence of some outcome in the bonus feature.

As indicated above, the base game may be a spinning reel game and the bonus feature may be a series of spinning reel games and the special symbol may be added to at least one of a plurality of reel strips so that the at least one reel strip increases in length. Instead, the special symbol may be added in substitution for existing symbols on at least one of a plurality of reel strips so that the at least one reel strip retains the same length as the other reel strips. Thus, the special symbol may be added to a middle reel strip of a five reel game or, instead, the special symbol may be added to each of a plurality of the reel strips, eg. the second, third, fourth and fifth reel strips of the game.

The special symbol may be a substitute symbol. The substitute symbol may, for example, occur on a middle reel such as the third reel of a five reel game. With the occurrence of an increasing number of substitute symbols during the series of spinning reel games, the chances of obtaining a prize winning combination with the substitute symbol substituting are increased.

According to an aspect of the invention, there is provided a method of operating a gaming machine, the gaming machine having a display and being controlled by a game controller arranged to control images displayed on the display, the method comprising triggering a bonus feature when a trigger condition occurs in a base game and incorporating an indicating means in the bonus feature to indicate to the player that a potential return to player percentage of the bonus feature is higher than that which is applicable in the base game that triggered the bonus feature.

The gaming machine is to be understood to include a gaming apparatus that does not require the wagering of a stake in order to play the game and further includes apparatus which is connectable to a network.

The format of the bonus feature may be the same as that of the base game apart from the indicator incorporated in the bonus feature.

The method may include implementing the indicator as a variable device that indicates to the player that, as the bonus feature progresses, the potential return to player percentage increases. More particularly, the method may include relating the indicator to the occurrence of a special symbol on the display during play of the bonus feature.

The indicator may be the quantity of a special symbol occurring during the bonus feature and the method may include increasing the occurrence of the special symbol as the bonus feature progresses.

BRIEF DESCRIPTION OF THE DRAWINGS

An embodiment of the invention is now described by way of example with reference to the accompanying diagrammatic drawings in which.

DETAILED DESCRIPTION

Figure 1:
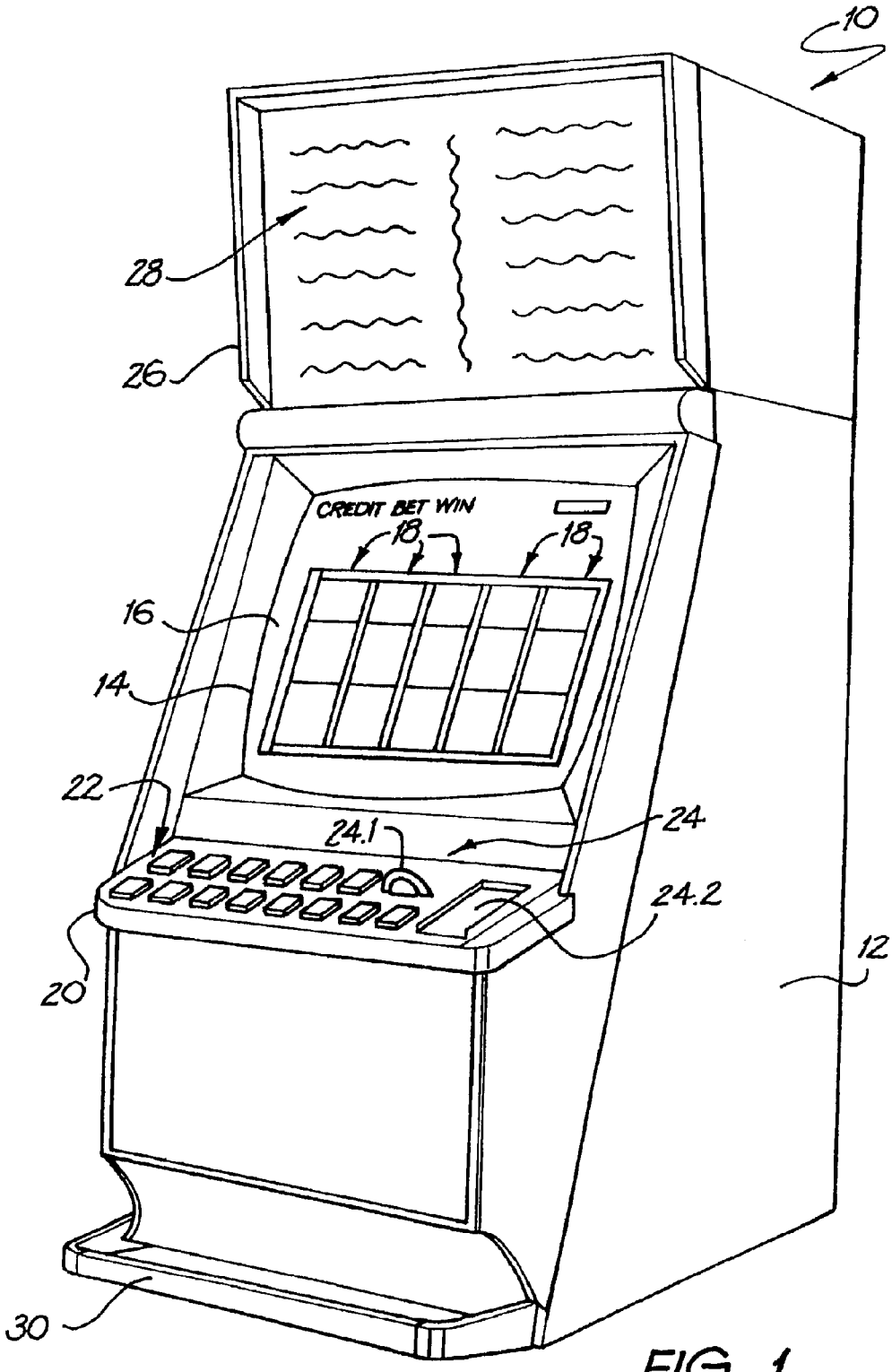
FIG. 1 shows a perspective view of a gaming machine, in accordance with the invention.

In FIG. 1, reference numeral 10 generally designates a gaming machine, including a game, in accordance with an embodiment of the invention. The machine 10 includes a console 12 having a display means in the form of a video display unit 14 on which a game 16 is played, in use. The video display unit 14 may be implemented as a cathode ray screen device, a liquid crystal display, a plasma screen, or the like. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
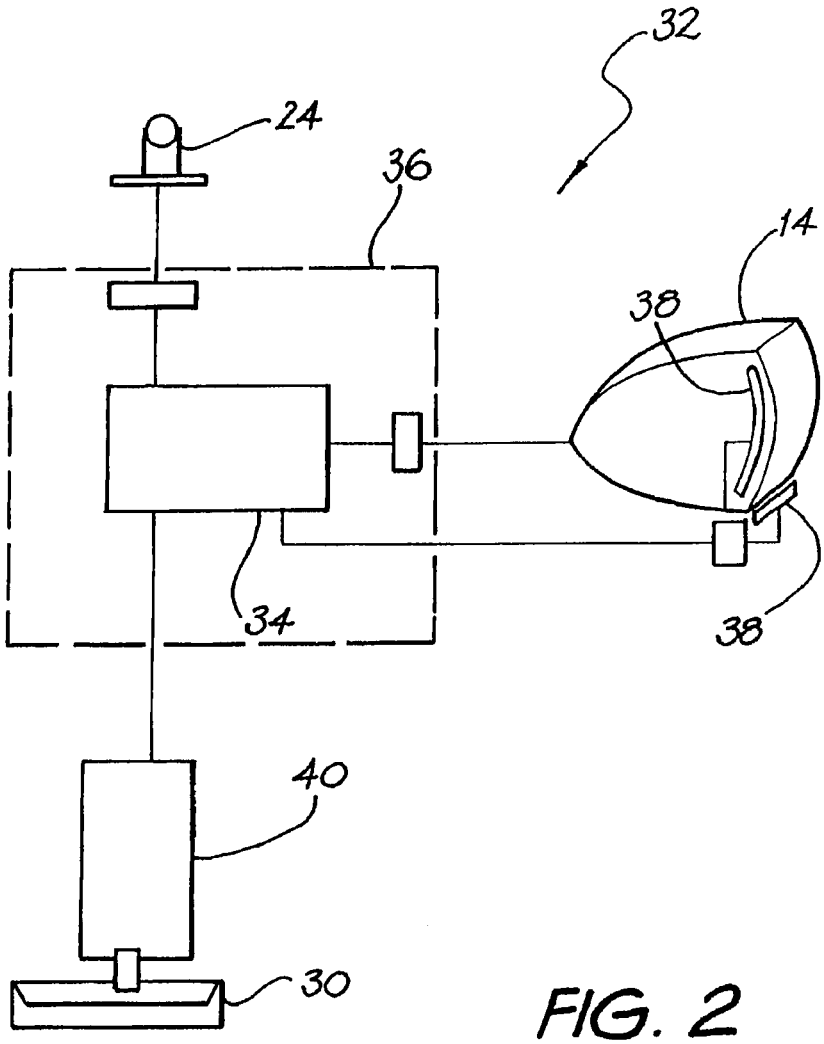
FIG. 2 shows a block diagram of a control circuit of the gaming machine.

Referring to FIG. 2 of the drawings, a control means or control circuit 32 is illustrated. A program which implements the game and user interface is run on a processor 34 of the control circuit 32. The processor 34 forms part of a controller 36 that drives the screen of the video display unit 14 and that receives input signals from sensors 38. The sensors 38 include sensors associated with the bank 22 of buttons and touch sensors mounted in the screen of the video display unit 14. The processor may be a computational device such as a microprocessor, microcontroller, programmable logic device or other suitable device. Instructions and data to control operation of the computational device are stored in a memory, which is in data communication with, or forms part of, the computational device. Typically, the gaming machine will include both volatile and non-volatile memory and more than one of each type of memory. The instructions to cause the controller to implement the present invention will be stored in the memory. The instructions and data for controlling operation of the computational device may be stored on a computer readable medium from which they are loaded into the gaming machine memory. The instructions and data may be conveyed to the gaming machine by means of a data signal in a transmission channel. Examples of such transmission channels include network connections, the Internet and wireless communication channels.

The controller 36 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 36 drives a payout mechanism 40 which, for example, may be a coin hopper for feeding coins to the coin tray 30 to make a pay out to a player when the player wishes to redeem his or her credit.

The game 16 played on the gaming machine 10 is a spinning reel game having five reels 18. Further, the game 16 includes a bonus feature where, upon the occurrence of a predetermined trigger condition in a base game of the game 16, a series of free games is awarded. Alternatively, the games in the bonus feature may need to be purchased by the player if the bonus feature is triggered. In other arrangements the player is only eligible for the bonus feature if the player has placed an ante bet.

The bonus feature includes an indicator, as will be described in greater detail below, which clearly indicates to a player that the potential return to player percentage in the bonus feature is higher than that which is applicable in respect of the base game of the game 16.

In the description which follows, it is assumed that wins, both in the base game and in the free games of the bonus feature, pay from left-to-right.

For the game 16 described in this example, it is assumed that the set of symbols applicable to the reel strips is as follows:

DLAMOND (substitute)
SYM_A
SYM_B
SYM_C
A
K
Q
10
9
S (scatter)

The DIAMOND symbol 58 (FIG. 4) is a substitute symbol which substitutes for all other symbols, apart from scatters in making up winning combinations.

For each symbol, apart from the DIAMOND symbol 58, there will be a paytable of prizes that applies for certain winning combinations. For example, 5 SYM_A on a payline pays 500 credits (multiplied by the bet per line), 4 SYM_A appearing in a left-to-right combination pays 100 credits (multiplied by the bet per line) and so on. Similarly, 5 scatter symbols S (the scatter symbol) appearing anywhere on the screen pays 20 credits (multiplied by the total bet), 4 scatter symbols S appearing anywhere on the screen pays 15 credits (multiplied by the total bet) and so on. The occurrence of at least 3 scatter symbols S also functions as a trigger condition to award the bonus feature, as will be described below.

For each winning payline combination, one of the applicable symbols may be substituted by the DIAMOND symbol 58 to make up the winning combination.

The simplified reel strips for the reels 18 for the base game of the game 16 are as follows:

| Position | Reel 1 | Reel 2 | Reel 3 | Reel 4 | Reel 5 |
|---|---|---|---|---|---|
| 1 | SYM_A | SYM_B | SYM_C | 10 | A |
| 2 | A | K | K | SYM_A | SYM_C |
| 3 | K | 9 | 9 | Q | J |
| 4 | SYM_B | SYM_C | A | A | 10 |
| 5 | Q | Q | 10 | 10 | 9 |
| 6 | DIAMOND | DIAMOND | DIAMOND | DIAMOND | DIAMOND |
| 7 | 10 | A | 9 | Q | A |
| 8 | A | 9 | SYM_A | SYM_C | SYM_C |
| 9 | 9 | SYM_A | K | K | Q |
| 10 | SYM_C | SYM_A | SYM_B | A | SYM_A |
| 11 | 10 | SYM_A | Q | SYM_B | A |
| 12 | J | SYM_A | 10 | Q | K |
| 13 | A | 10 | K | J | SYM_C |
| 14 | 10 | J | J | A | J |
| 15 | SCAT | SCAT | SCAT | SCAT | SCAT |
| 16 | 9 | 10 | 9 | 9 | A |
| 17 | 10 | A | 10 | Q | SYM_B |
| 18 | A | 9 | K | SYM_B | J |
| 19 | 9 | 10 | 9 | K | SYM_C |
| 20 | J | A | 10 | A | J |

Hence, the base game of the game 16 may have some occurrences of the same symbol positioned next to each other for visual effect such as, in the case of reel strip 2, four occurrences of the top award symbol, SYM_A, are arranged next to one another in positions 9-12.

As indicated above, the occurrence of three scatter symbols S in the base game of the game 16 triggers the bonus feature being, as described above, a series of ten free games.

Figure 3:
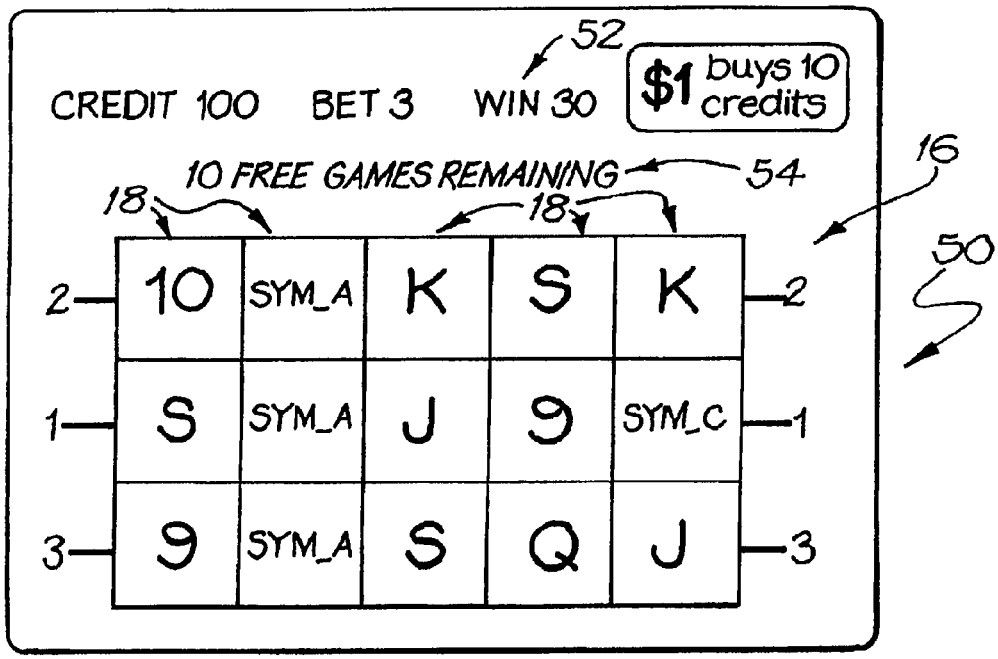
FIG. 3 shows a screen display after a base game of a game played on the gaming machine of FIG. 1.

FIG. 3 of the drawings shows a screen display 50 of the base game where it is assumed that the reels 18 have stopped at reel strip positions 15, 11, 14, 16 and 13, respectively, on the first payline.

The occurrence of the three scatter symbols S results in a win of ten credits (multiplied by three credits being the total bet) for a total win of thirty credits. This is displayed on a win meter 52 of the gaming machine 10.

A message 54 is displayed on the screen display indicating that the bonus feature has been awarded and that ten free games are remaining.

Prior to each free game of the series of free games, one DIAMOND symbol 58 (FIG. 4) is added to the third reel strip. The additional DIAMOND symbol 58 is added adjacent another occurrence of the DIAMOND symbol 58 on the third reel strip. Accordingly, prior to the first free game, the reel strips will change to the following:

| Position | Reel 1 | Reel 2 | Reel 3 | Reel 4 | Reel 5 |
|---|---|---|---|---|---|
| 1 | SYM_A | SYM_B | SYM_C | 10 | A |
| 2 | A | K | K | SYM_A | SYM_C |
| 3 | K | 9 | 9 | Q | J |
| 4 | SYM_B | SYM_C | A | A | 10 |
| 5 | Q | Q | 10 | 10 | 9 |
| 6 | DIAMOND | DIAMOND | DIAMOND | DIAMOND | DIAMOND |
| 7 | 10 | A | DIAMOND | Q | A |
| 8 | A | 9 | 9 | SYM_C | SYM_C |
| 9 | 9 | SYM_A | SYM_A | K | Q |
| 10 | SYM_C | SYM_A | K | A | SYM_A |
| 11 | 10 | SYM_A | SYM_B | SYM_B | A |
| 12 | J | SYM_A | Q | Q | K |
| 13 | A | 10 | 10 | J | SYM_C |
| 14 | 10 | J | K | A | J |
| 15 | SCAT | SCAT | J | SCAT | SCAT |
| 16 | 9 | 10 | SCAT | 9 | A |
| 17 | 10 | A | 9 | Q | SYM_B |
| 18 | A | 9 | 10 | SYM_B | J |
| 19 | 9 | 10 | K | K | SYM_C |
| 20 | J | A | 9 | A | J |
| 21 | | | 10 | | |

That is, reel strip 3 has been extended by one position and a further DIAMOND symbol 58 has been inserted at position 7 adjacent to the other occurrence of the DIAMOND symbol 58 on the third reel strip.

Figure 4:
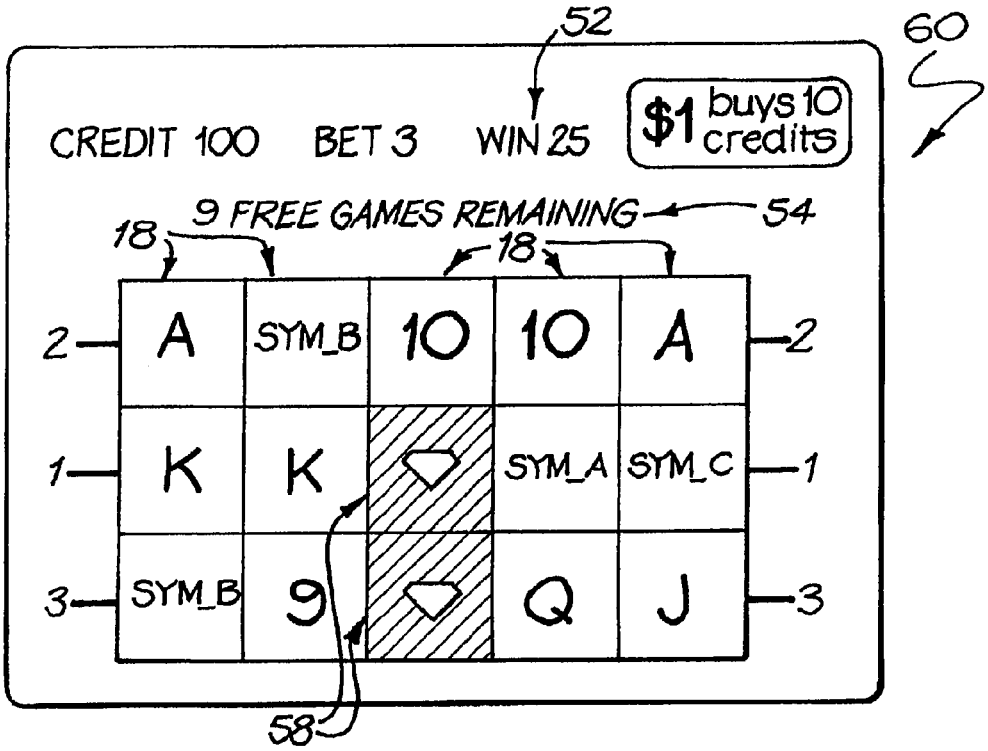
FIG. 4 shows a screen display after a first game of a bonus feature of the game following the base game.
Figure 5:
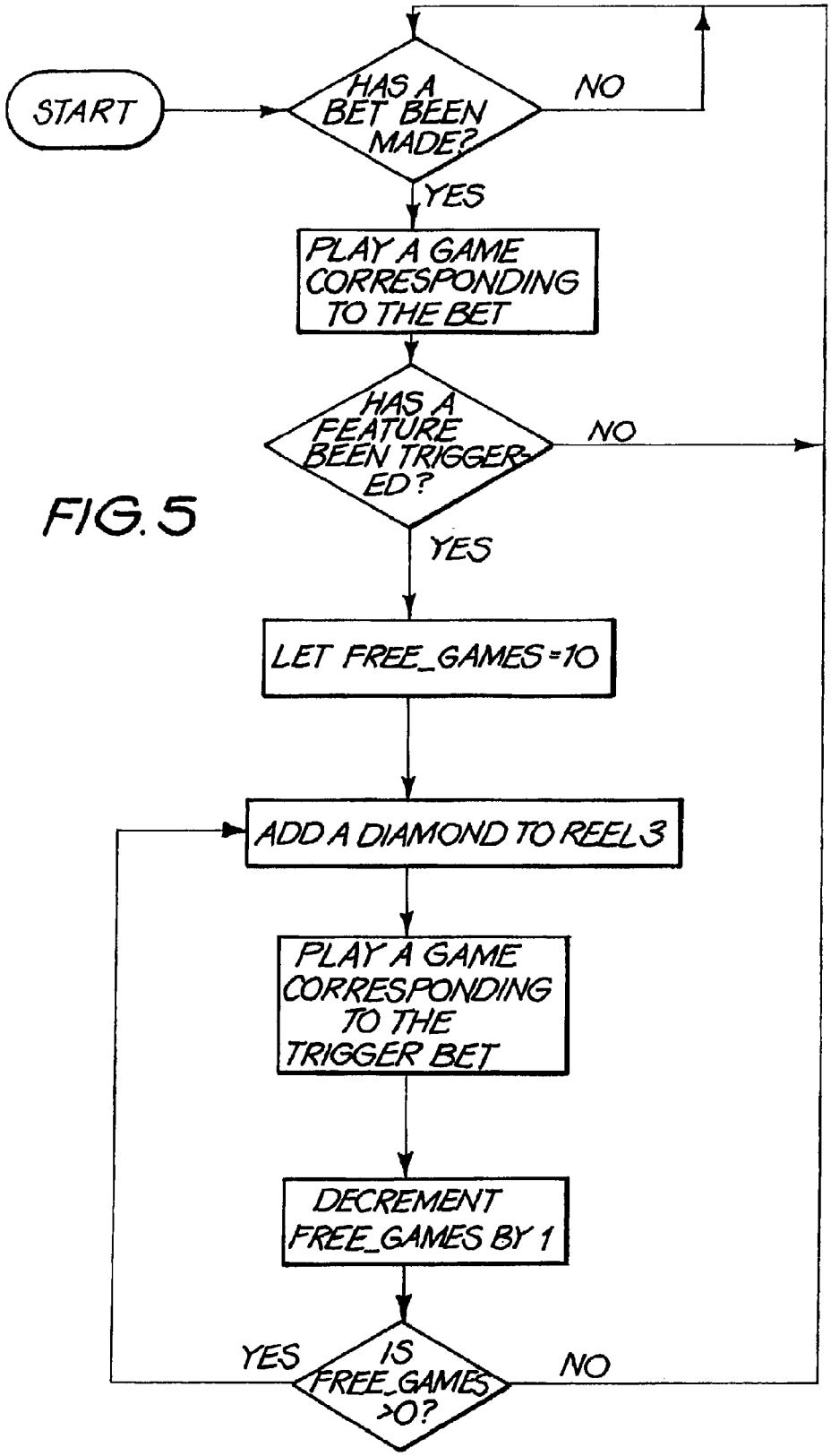
FIG. 5 shows a flow chart of the game, including the bonus feature.

Assuming that in the first free game the reels 18 stop at reel strip positions 3, 2, 6, 2 and 2, the screen display is as shown in FIG. 4 of the drawings and is designated generally by the reference numeral 60.

For the winning combination of 3.times.K (with the DIAMOND symbol 58 substituting) on payline 1, a prize of 25 credits, the player playing one credit per line, is awarded and displayed on the win meter 52. There are then nine free games remaining as indicated by the message 54.

After the tenth free game, ten additional DIAMOND symbols 58 have been added to the third reel strip so that the reel strips now appear as follows:

| Position | Reel 1 | Reel 2 | Reel 3 | Reel 4 | Reel 5 |
|---|---|---|---|---|---|
| 1 | SYM_A | SYM_B | SYM_C | 10 | A |
| 2 | A | K | K | SYM_A | SYM_C |
| 3 | K | 9 | 9 | Q | J |
| 4 | SYM_B | SYM_C | A | A | 10 |
| 5 | Q | Q | 10 | 10 | 9 |
| 6 | DIAMOND | DIAMOND | DIAMOND | DIAMOND | DIAMOND |
| 7 | 10 | A | DIAMOND | Q | A |
| 8 | A | 9 | DIAMOND | SYM_C | SYM_C |
| 9 | 9 | SYM_A | DIAMOND | K | Q |
| 10 | SYM_C | SYM_A | DIAMOND | A | SYM_A |
| 11 | 10 | SYM_A | DIAMOND | SYM_B | A |
| 12 | J | SYM_A | DIAMOND | Q | K |

-continued

| Position | Reel 1 | Reel 2 | Reel 3 | Reel 4 | Reel 5 |
|---|---|---|---|---|---|
| 13 | A | 10 | DIAMOND | J | SYM_C |
| 14 | 10 | J | DIAMOND | A | J |
| 15 | SCAT | SCAT | DIAMOND | SCAT | SCAT |
| 16 | 9 | 10 | DIAMOND | 9 | A |
| 17 | 10 | A | 9 | Q | SYM_B |
| 18 | A | 9 | SYM_A | SYM_B | J |
| 19 | 9 | 10 | K | K | SYM_C |
| 20 | J | A | SYM_B | A | J |
| 21 | | | Q | | |
| 22 | | | 10 | | |
| 23 | | | K | | |
| 24 | | | J | | |
| 25 | | | SCAT | | |
| 26 | | | 9 | | |
| 27 | | | 10 | | |
| 28 | | | K | | |
| 29 | | | 9 | | |
| 30 | | | 10 | | |

Accordingly, as the free games progress, the player's chances of winning are greatly increased because of the higher chance of getting a substitute symbol on the third reel strip. The DIAMOND symbol 58 is designed to stand out from the remaining symbols on the reels 18 so that, as the reels 18 spin, the player has a readily identifiable visual effect of seeing the DIAMOND symbols 58 spinning past. Hence, as extra DIAMOND symbols 58 are added to the third reel, the player has the visual confirmation that the potential return to player percentage is increasing due to the increased number of DIAMOND symbols 58 spinning past. It will be appreciated that, by the later games of the series of free games, there is a very high chance of one or more DIAMOND symbols 58 being displayed when the third reel 18 stops spinning.

Instead of the reel strip associated with the third reel 18 being increased in length by the addition of further DIAMOND symbols 58, the reel strip associated with the third reel 18 could remain the same length as the other reel strips by substituting the DIAMOND symbol 58 for other symbols presently on the reel strip of the third reel 18.

In another embodiment of the invention (not shown), additional DIAMOND symbol 58 are added to each of the second, third, fourth and fifth reels 18 as the free games of the series of free games progresses therefore increasing the likelihood of a winning outcome being obtained even further, particularly, in the later games of the series of free games.

It is also not necessary that the positioning of the other symbol on the reel strips remain completely constant during all the free games of the series of free games. Their distribution may alter.

It is a particular advantage of the invention that an indicator is provided which readily indicates to a player that the potential return to player percentage for the free game is higher and increases during the bonus feature. Hence, the player need not, if the player does not wish to do so, consult a "Help" screen of the gaming machine 10 to ascertain how the bonus feature works. The applicant believes that this will enhance player enjoyment of the game. It will also enhance revenue for operators of a venue in which the gaming machine 10 is installed as players will be less reticent about playing the game if they know, in a simplified manner, how the bonus feature works and that it is not necessary to consult a "Help" screen should they not wish to do so.

Another major benefit of the invention is that, as the bonus feature progresses, the chances of winning increases. Hence, the last impression that is left in the mind of the player is likely to be a good one as the player is more likely to end the feature with one or more winning games and higher payouts than non-winning games and lower payouts.

Figure 6:
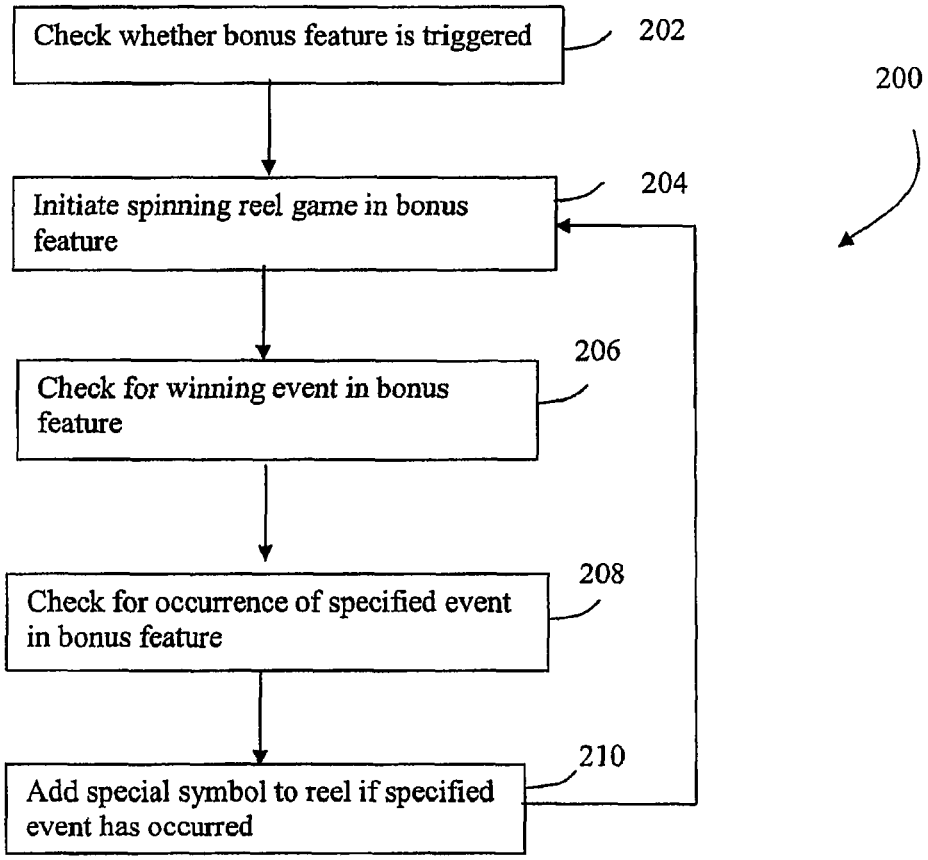
FIG. 6 shows a flow chart of an embodiment of the game in which a special symbol is added to a reel upon the occurrence of a specified outcome in the bonus feature.

In an alternative arrangement, the special symbol is added upon the occurrence of some specified outcome in the bonus feature. The method 200 is illustrated in FIG. 6. In an initial process 202, software running on the gaming machine 10 checks whether the bonus feature has been triggered. In one arrangement, 3 scatter symbols trigger the bonus feature. In some arrangements the bonus feature is only available if the player has placed an ante-bet. If the bonus feature has been triggered, then in process 204 the gaming machine initiates the bonus feature. In the described arrangement, the bonus feature is a spinning reel game. The bonus feature may be a free game series spun on the spinning reels. Alternatively, once the bonus feature has been triggered, the player may be required to purchase reel spins in the bonus feature. The feature may be played with all of the reels being spun. Alternatively, the game may be played with one or more of the reels being held and other ones of the reels being spun. The player may be provided with the option of holding a reel or selecting which of the reels to spin.

The symbols on the reels spun in the bonus feature include at least one accumulator symbol. The accumulator symbol may be included on the reels specifically for the bonus feature. Alternatively, the accumulator symbol may be one of the symbols that appears on the reels during the base feature from which the bonus feature was triggered.

In step 206 the controlling software checks whether a winning event has been spun up on the spinning reels 18. The controlling software also checks, in process 208, whether a specified event has occurred. In the described arrangement the specified event occurs if at least one accumulator symbol is spun up on the spinning reels 18.

If an accumulator symbol is spun up, then in step 210 the controlling software adds at least one special symbol to one of the spinning reels. In one arrangement the accumulator symbol acts as a wild symbol and the special symbol added to the reels is also a wild. The added special symbol may differ from other symbols on the reels with respect to one or more attributes. For example, an added wild symbol may be golden in colour. This will differentiate between the normal wild symbols and the added symbols, providing visual information to the player.

The added special symbol may also be associated with a higher payout. Thus, if a winning event occurs that includes one or more of the added special symbols, then the payout may be made according to a higher scale.

In one arrangement a new 'super' score card is displayed that is associated with the added symbols. The super score card may be displayed in the same colour as the added special symbols.

The special symbol may be added to the same reel on which the accumulator symbol was spun up. Alternatively, the special symbols may all be added to a designated reel.

In one arrangement the special symbol is added by increasing the length of the reel to which it is added. Alternatively, the added special symbol may replace one of the symbols previously on the reel. In a further alternative the special symbols may be superimposed on existing symbols. The existing symbol and/or the special symbol may be rendered with a degree of transparency such that both symbols are simultaneously visible on the reels.

The special symbols may be added adjacent to similar special or accumulated symbols to give a stacked effect as described above with references to FIGS. 3 and 4. However, in other implementations the special symbols may be added to the reel at different points.

From process 210, control flow returns to process 204, where the spinning reels are spun once again in the bonus feature. In some arrangements the player may be required to purchase further spins. In other arrangements the player may be awarded a series of free spins.

Then processes 206 and 208 repeat in which the controlling software checks for winning events in the bonus feature. If the winning event involves an added special symbol, then the payout may be made according to the new super score card. The controlling software also checks for the occurrence of one or more accumulator symbols. The added wild symbols may act as accumulator symbols, triggering the addition of further wild symbols.

As play of the bonus feature progresses, the reels may begin to fill up with the added special symbols. This increases the probability of a winning event occurring and may also increase the probability of an accumulator symbol being spun up and further special symbols being consequently added. The number of special symbols on the spinning wheels provides a visual indication to the user of the changing probability. This visual indication may be further enhanced if the special symbols have a distinctive visual attribute such as a changed colour.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of operating a gaming machine having a display and a game controller arranged to control images of symbols displayed on the display, the game controller being arranged to play a spinning reel game wherein at least one random event is caused to be displayed on the display and, if a predefined winning event occurs, the machine awards a prize, the method comprising:

initiating a feature including a series of spinning reel games, each of the spinning reel games having associated reel strips carrying a plurality of symbols, including at least one accumulator symbol, and at least one special symbol different than said accumulator symbol;

in response to said at least one accumulator symbol being spun up on one reel strip, adding an additional at least one special symbol to said one reel strip prior to a subsequent reel spin to increase the chance of said special symbol being spun up on said subsequent reel spin, and thereby increasing a length of said one reel strip and without replacing symbols on said one reel strip;

spinning said reel strips to provide a visible indication of said increase in the chance of said special symbol being part of a winning event during the spinning reel game; and awarding a prize if said special symbol forms part of a winning event.

2. A method according to claim 1 wherein the at least one added special symbol acts as an accumulator symbol in a following reel spin.

3. A method according to claim 1 wherein the at least one added special symbol has an associated visual attribute.

4. A method according to claim 3 wherein the visual attribute of the special symbol is a colour distinguishable from colours of other symbols on the spinning reels.

5. A method according to claim 1 wherein the added special symbols are associated with a scorecard.

6. A method according to claim 5 wherein the prize depends on the associated scorecard if said special symbol forms part of a winning event.

7. A method according to claim 1 wherein said adding step adds at least one special symbol to said reel strip such that a length of the reel strip remains constant.

8. A method according to claim 7 wherein the added special symbol replaces a symbol on the reel strip.

9. A method of operating a gaming machine having a display and a game controller arranged to control images of symbols displayed on the display, the game controller being arranged to play a spinning reel game wherein at least one random event is caused to be displayed on the display and, if a predefined winning event occurs, the machine awards a prize, the method comprising:

initiating a feature including a series of spinning reel games, each of the spinning reel games having associated reel strips carrying a plurality of symbols;

in response to the occurrence of a specified outcome on one reel strip, adding an additional at least one special symbol to said one reel strip prior to a subsequent reel spin, the addition of the special symbol increasing the probability of a winning event occurring on said subsequent reel spin, and thereby increasing a length of said one reel strip and without replacing symbols on said one reel strip;

spinning said reel strips; and awarding a prize if a winning event occurs.

10. A method according to claim 9 wherein the specified outcome is the display of a wild symbol.

11. A gaming machine having a display and a game controller arranged to control images of symbols displayed on the display, the game controller being arranged to play a spinning reel game wherein at least one random event is caused to be displayed on the display and, if a predefined winning event occurs, the machine awards a prize, the game controller arranged to:

initiate a feature including a series of spinning reel games, each of the spinning reel games having associated reel strips carrying a plurality of symbols, including at least one accumulator symbol, and at least one special symbol different than said accumulator symbol;

in response to said at least one accumulator symbol being spun up on one reel strip, add an additional at least one special symbol to said one reel strip prior to a subsequent reel spin to increase the chance of said special symbol being spun up on said subsequent reel spin, and thereby increasing a length of said one reel strip and without replacing symbols on said one reel strip;

spin said reel strips to provide a visible indication of said increase in the chance of said special symbol being part of a winning event during the spinning reel game; and award a prize if said special symbol forms part of a winning event.

12. A non-transitory computer program product comprising machine-readable program code recorded on a machine-readable recording medium, for controlling the operation of a data processing apparatus on which the program code executes to perform a method of operating a gaming machine having a display and a game controller arranged to control images of symbols displayed on the display, the game controller being arranged to play a spinning reel game wherein at least one random event is caused to be displayed on the display and, if a predefined winning event occurs, the machine awards a prize, the method comprising:

initiating a feature including a series of spinning reel games, each of the spinning reel games having associated reel strips carrying a plurality of symbols, including at least one accumulator symbol, and at least one special symbol different than said accumulator symbol;

in response to said at least one accumulator symbol being spun up on one reel strip, adding an additional at least one special symbol to said one reel strip prior to a subsequent reel spin to increase the chance of said special symbol being spun up on said subsequent reel spin, and thereby increasing a length of said one reel strip and without replacing symbols on said one reel strip;

spinning said reel strips to provide a visible indication of said increase in the chance of said special symbol being part of a winning event during the spinning reel game; and awarding a prize if said special symbol forms part of a winning event.

13. A non-transitory computer program encoded with machine-readable program code for controlling the operation of a data processing apparatus on which the program code executes to perform a function of a gaming machine having a display and a game controller arranged to control images of symbols displayed on the display, the game controller being arranged to play a spinning reel game wherein at least one random event is caused to be displayed on the display and, if a predefined winning event occurs, the machine awards a prize, the function comprising:

initiating a feature including a series of spinning reel games, each of the spinning reel games having associated reel strips carrying a plurality of symbols, including at least one accumulator symbol, and at least one special symbol different than said accumulator symbol;

in response to said at least one accumulator symbol being spun up on one reel strip, adding an additional at least one special symbol to said one reel strip to increase the chance of said special symbol being spun up on said subsequent reel spin, and thereby increasing a length of said one reel strip and without replacing symbols on said one reel strip;

spinning said reel strips to provide a visible indication of said increase in the chance of said special symbol being part of a winning event during the spinning reel game; and awarding a prize if said special symbol forms part of a winning event.

* * * * *